US010784606B2

(12) United States Patent
Cheng et al.

(10) Patent No.: US 10,784,606 B2
(45) Date of Patent: Sep. 22, 2020

(54) ELECTRICAL CONNECTOR AND CONNECTOR ASSEMBLY

(71) Applicant: LOTES CO., LTD, Keelung (TW)

(72) Inventors: Wei Jin Cheng, Keelung (TW); Wen Chang Chang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/695,388

(22) Filed: Nov. 26, 2019

(65) Prior Publication Data

US 2020/0169019 A1 May 28, 2020

Related U.S. Application Data

(60) Provisional application No. 62/772,159, filed on Nov. 28, 2018.

(30) Foreign Application Priority Data

Apr. 2, 2019 (CN) ..... 2019 1 0259398

(51) Int. Cl.
*H01R 3/00* (2006.01)
*H01R 12/72* (2011.01)
(Continued)

(52) U.S. Cl.
CPC ..... *H01R 12/724* (2013.01); *H01R 13/6582* (2013.01); *H01R 13/6597* (2013.01)

(58) Field of Classification Search
CPC .. H01R 9/0742; H01R 9/0735; H01R 9/0714; H01R 23/664
(Continued)

(56) References Cited

U.S. PATENT DOCUMENTS 6,390,833 B1 * 5/2002 Chang ..... H01R 13/6485 439/108
6,984,137 B2 * 1/2006 Akasaka ..... H01R 13/6585 439/108
(Continued)

FOREIGN PATENT DOCUMENTS

CN 101183753 A 5/2008
CN 101877444 A 11/2010
(Continued)

*Primary Examiner* — Phuong Chi Thi Nguyen
(74) *Attorney, Agent, or Firm* — Locke Lord LLP; Tim Tingkang Xia, Esq.

(57) ABSTRACT

An electrical connector is mounted downward on a circuit board to mate with a mating member. The electrical connector includes an insulating body having a front end surface, where the front end surface is backward concavely provided with a mating slot for the mating member to be inserted therein, and at least one ground terminal. Each ground terminal has a main body provided on the insulating body. A first elastic arm and a second elastic arm extend forward from the main body. The first elastic arm has a first contact portion in downward contact with an upper shielding member. The second elastic arm has a second contact portion in downward contact with the mating member. The first contact portion is located in front of the second contact portion. An acting force by the first elastic arm counteracts a supporting force by the circuit board, preventing the insulating body from deformation.

20 Claims, 14 Drawing Sheets

(51) Int. Cl.
*H01R 13/6582* (2011.01)
*H01R 13/6597* (2011.01)

(58) Field of Classification Search
USPC ..... 439/492, 491, 496, 493, 495, 499
See application file for complete search history.

(56) References Cited

U.S. PATENT DOCUMENTS

| | | | | |
|---|---|---|---|---|
| 7,059,908 | B2 * | 6/2006 | Yamaguchi ..... | H01R 13/6583 439/607.17 |
| 9,048,583 | B2 * | 6/2015 | Johnescu ..... | H01R 13/6471 |
| 9,705,273 | B2 * | 7/2017 | Guetig ..... | H01R 12/592 |

FOREIGN PATENT DOCUMENTS

| | | | |
|---|---|---|---|
| CN | 101316019 | B | 7/2011 |
| CN | 105390884 | A | 3/2016 |

* cited by examiner

ELECTRICAL CONNECTOR AND CONNECTOR ASSEMBLY

CROSS-REFERENCE TO RELATED PATENT APPLICATION

This non-provisional application claims priority to and the benefit of, pursuant to 35 U.S.C. § 119(e), U.S. provisional patent application Ser. No. 62/772,159 filed Nov. 28, 2018, and under 35 U.S.C. § 119(a), patent application Serial No. CN201910259398.3 filed in China on Apr. 2, 2019. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and a connector assembly, and particularly to an electrical connector and a connector assembly which prevent deformation and prolong the service life thereof.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Currently, electrical connectors have been applied to various fields in life. With the development of existing science and technology, the exchange rate of information is getting higher, and requirements for the electrical connectors are getting higher. It is required that the electrical connector assembly supports a high transmission rate, and the service life of the electrical connector is prolonged. An existing electrical connector is used to mate with a mating component, and has an insulating body. The front end of the insulating body is backward concavely provided with a mating slot to accommodate the mating component. Multiple ground terminals are accommodated in the insulating body. Each ground terminal has a first elastic arm and a second elastic arm extending forward. The first elastic arm has an abutting portion protruding upward into the mating slot to upward abut a lower side of the mating component. The second elastic arm has a contact portion protruding downward into the mating slot to be in downward contact with a conductive sheet provided at an upper side of the mating component. The abutting portion is located in front of the contact portion.

In this electrical connector, when the electrical connector mates with the mating component, the first elastic arm upward abuts the mating component, thereby applying an upward force to the insulating body, which causes the insulating body to have a bending deformation, and affects the service life of the electrical connector.

Therefore, a heretofore unaddressed need to design a new electrical connector exists in the art to address the aforementioned deficiencies and inadequacies.

SUMMARY

The present invention is directed to an electrical connector and a connector assembly, which realize shielding, prevent deformation and prolong the service life.

To achieve the foregoing objective, the present invention adopts the following technical solutions.

An electrical connector is mounted downward on a circuit board, and is configured to mate with a mating member having an upper shielding member located at an upper side thereof and at least one ground conductive sheet. The electrical connector includes: an insulating body, provided with a front end surface, wherein the front end surface is backward concavely provided with a mating slot for the mating member to be inserted therein; and at least one ground terminal, wherein each of the at least one ground terminal has a main body provided on the insulating body, a first elastic arm and a second elastic arm extend forward from the main body, the first elastic arm has a first contact portion exposed downward from the mating slot to be in downward contact with the upper shielding member, the second elastic arm has a second contact portion exposed downward from the mating slot to be in downward contact with the ground conductive sheet, and the first contact portion is located in front of the second contact portion.

In certain embodiments, the mating member has a lower shielding member located at a lower side thereof, a third elastic arm extends forward from the main body; the third elastic arm has a third contact portion exposed upward from the mating slot to be in upward contact with the lower shielding member, and the third contact portion is located between the first contact portion and the second contact portion.

In certain embodiments, the main body has a connecting portion connecting the second elastic arm and the third elastic arm, and a distance between the second contact portion and the third contact portion in a vertical direction is greater than a width of the connecting portion in the vertical direction.

In certain embodiments, the main body is provided with a through hole running therethrough in a left-right direction, the through hole is located behind the connecting portion, and the through hole and the connecting portion are aligned with each other in a front-rear direction.

In certain embodiments, the electrical connector further includes a metal shell covering outside the insulating body, wherein the metal shell comprises a top plate located above the insulating body, each of two sides of the top plate downwards extends to form a side plate, the metal shell has at least one abutting arm connected to the top plate, and the abutting arm is exposed from the mating slot to be in contact with the upper shielding member.

In certain embodiments, each of the at least one abutting arm is formed by bending and extending downward from a front end of the top plate, at least one bending portion is formed by bending and extending downward and backward from the front end of the top plate; and the bending portion and the insulating body are in fastening fit.

In certain embodiments, at least one abutting elastic sheet is formed by protruding downward from a plate surface of the top plate, and the abutting elastic sheet downward abuts the first elastic arm.

In certain embodiments, at least one contact elastic arm extends backward from the top plate to be in contact with the ground terminal.

In certain embodiments, the insulating body has a back end surface, the back end surface is concavely provided with a mounting slot forward from back thereof, the mounting slot runs upward through the insulating body, an extending arm extends upward from the main body and protrudes into the mounting slot, and the contact elastic arm laterally abuts the extending arm in a left-right direction.

In certain embodiments, the electrical connector further includes two fixing members located at a left side and a right side of the mating slot, wherein each of the fixing members is provided with a retaining portion fixed to the insulating body, an extending portion bending and extending from the retaining portion, and a buckling arm extending forward from the extending portion, and the buckling arm has a buckling portion protruding into the mating slot to buckle with the mating member.

In certain embodiments, the insulating body has a top wall located above the mating slot, a bottom wall located below the mating slot, and a rear wall connecting the top wall and the bottom wall, and the retaining portion of each of the fixing members is retained to the top wall and extend forward out of the rear wall.

In certain embodiments, the buckling arm has a bending section, and the bending section is formed by protruding toward the mating slot in a left-right direction.

In certain embodiments, the retaining portion and the buckling arm are located at different heights in a vertical direction.

An electrical connector is mounted downward on a circuit board, and is configured to mate with a mating member having an upper shielding member located at an upper side thereof, at least one signal conductive sheet, at least one ground conductive sheet and a lower shielding member located at a lower side thereof. The electrical connector includes: an insulating body, provided with a front end surface, wherein the front end surface is backward concavely provided with a mating slot for the mating member to be inserted therein; at least one ground terminal, wherein each of the at least one ground terminal has a main body provided on the insulating body, a first elastic arm, a second elastic arm and a third elastic arm extend forward from the main body, the first elastic arm has a first contact portion exposed downward from the mating slot to be in downward contact with the upper shielding member, the second elastic arm has a second contact portion exposed downward from the mating slot to be in downward contact with the ground conductive sheet, the third elastic arm has a third contact portion exposed upward from the mating slot to be in upward contact with the lower shielding member, and the first contact portion is located in front of the second contact portion and the third contact portion; and at least one signal terminal, provided on the insulating body, wherein each of the at least one signal terminal has a fourth contact portion exposed downward from the mating slot to be in downward contact with the signal conductive sheet.

In certain embodiments, the main body has a connecting portion connecting the second elastic arm and the third elastic arm, the second contact portion is located above the connecting portion, and the third contact portion is located below the connecting portion.

In certain embodiments, the main body is provided with a through hole running through the main body in a left-right direction, the through hole is located behind the connecting portion, the through hole has an upper edge and a lower edge, and the connecting portion is located between the upper edge and the lower edge.

In certain embodiments, the electrical connector further includes a metal shell covering outside the insulating body, wherein the metal shell comprises a top plate located above the insulating body, each of two sides of the top plate downwards extends to form a side plate, the metal shell has at least one abutting arm connected to the top plate and at least one contact elastic arm extending backward from the top plate, the abutting arm is exposed from the mating slot to be in contact with the upper shielding member, and the contact elastic arm is in contact with the ground terminal.

In certain embodiments, the metal shell has at least one abutting elastic sheet formed by punching from the plate surface of the top plate, and the abutting elastic sheet is a cantilever extending upward in a front-rear direction and downward abutting the first elastic arm.

In certain embodiments, the insulating body has a back end surface, the back end surface is concavely provided with at least one mounting slot forward from back thereof, the mounting slot is located above the mating slot and runs upward through the insulating body, an abutting arm extends upward from the main body and protrudes into the mounting slot, and the abutting arm and the contact elastic arm are in lateral contact in the left-right direction.

A connector assembly includes: an electrical connector, configured to be mounted downward on a circuit board, wherein the electrical connector has an insulating body and at least one ground terminal provided on the insulating body, the insulating body is provided with a front end surface, the front end surface is backward concavely provided with a mating slot, each of the at least one ground terminal has a main body provided on the insulating body, a first elastic arm and a second elastic arm extend forward from the main body, the first elastic arm has a first contact portion exposed downward from the mating slot, the second elastic arm has a second contact portion exposed downward from the mating slot, and the first contact portion is located in front of the second contact portion; and a mating member, inserted into the mating slot, wherein the mating member has an upper shielding member located at an upper side thereof and at least one ground conductive sheet, an upper surface of the upper shielding member is provided with an inclined surface inclining downward, the inclined plane is located between the first contact portion and the second contact portion to guide the first contact portion, the first contact portion is in downward electrical contact with the upper shielding member, and the second contact portion is in downward electrical contact with the ground conductive sheet.

In certain embodiments, the upper shielding member is provided with a copper foil and a gold layer plated on an upper surface of the copper foil, and the first contact portion abuts the gold layer.

In certain embodiments, the upper shielding member comprises a copper foil provided with an opening and a gold layer embedded in the opening, and the first contact portion abuts the gold layer.

Compared with the related art, the electrical connector and the connector assembly according to certain embodiments of the present invention have the following beneficial effects.

The ground terminal is provided with the first elastic arm and the second elastic arm, which are located at a same side of the mating member. The first contact portion downward abuts the upper shielding member, and the second contact portion is in downward contact with the ground conductive sheet. The first contact portion is located in front of the second contact portion. The first elastic arm applies a downward acting force, which is transmitted through the mating member to act on the insulating body. Since the electrical connector is mounted downward on the circuit board, the circuit board located below the insulating body provides an upward supporting force to the insulating body, which counteracts the downward acting force applied by the first elastic arm, preventing the insulating body from deformation, and prolonging the service life of the electrical connector and the connector assembly.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
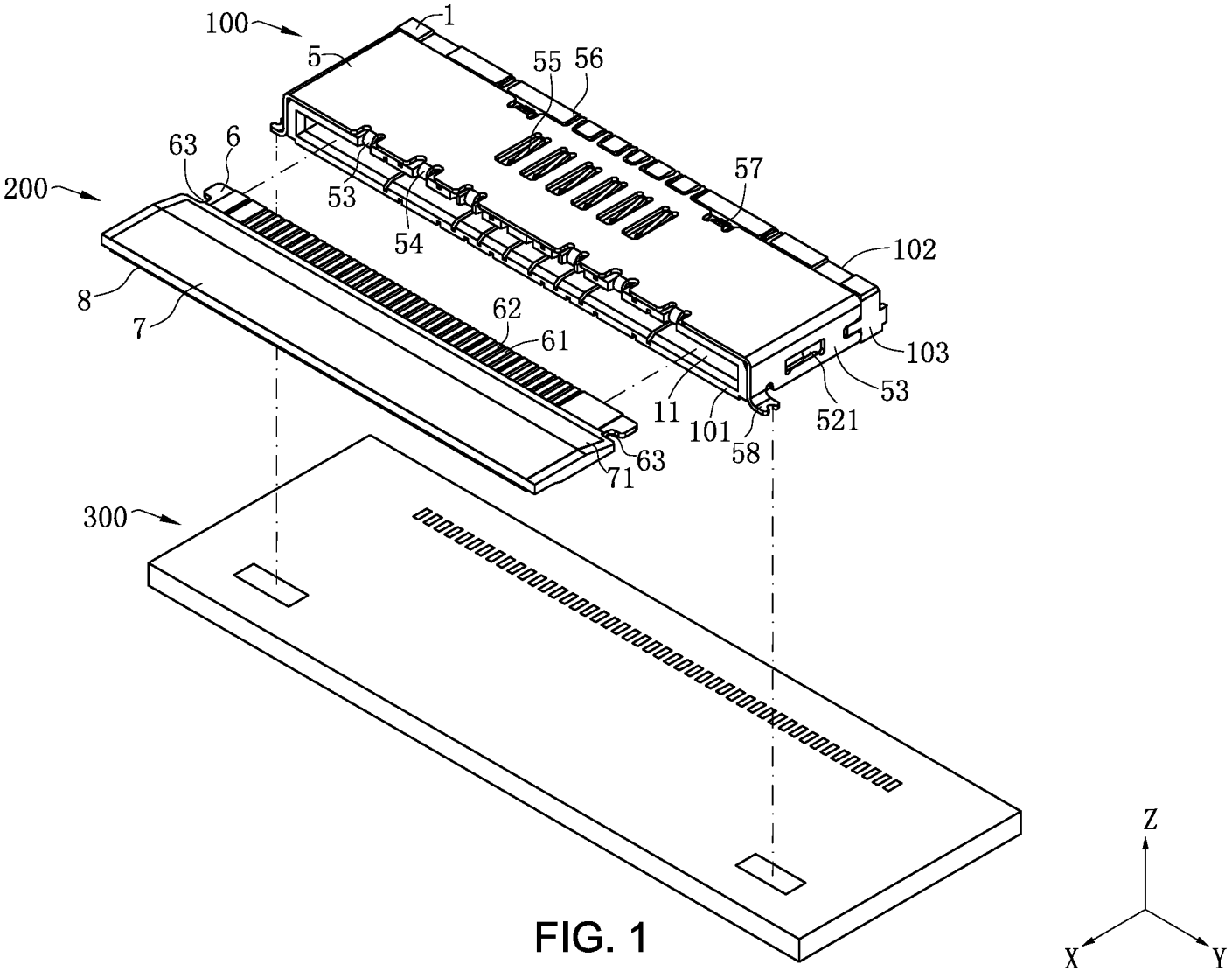
FIG. 1 is a perspective view of a connector assembly and a circuit board according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-14. In accordance with the purposes of this invention, as embodied and broadly described herein, this invention, in one aspect, relates to an electrical connector and a connector assembly.

For description convenience, a three-dimensional coordinate is defined, in which an x axis is a front-rear direction, a y axis is a left-right direction, and a z axis is a vertical (i.e., up-down) direction.

FIG. 1 shows a connector assembly (not numbered) according to certain embodiments of the present invention. The connector assembly includes an electrical connector 100 and a mating member 200 mating with each other. The electrical connector 100 is mounted downward on a circuit board 300, and the mating member 200 is inserted backward to the electrical connector 100 to form electrical connection therebetween.

Figure 2:
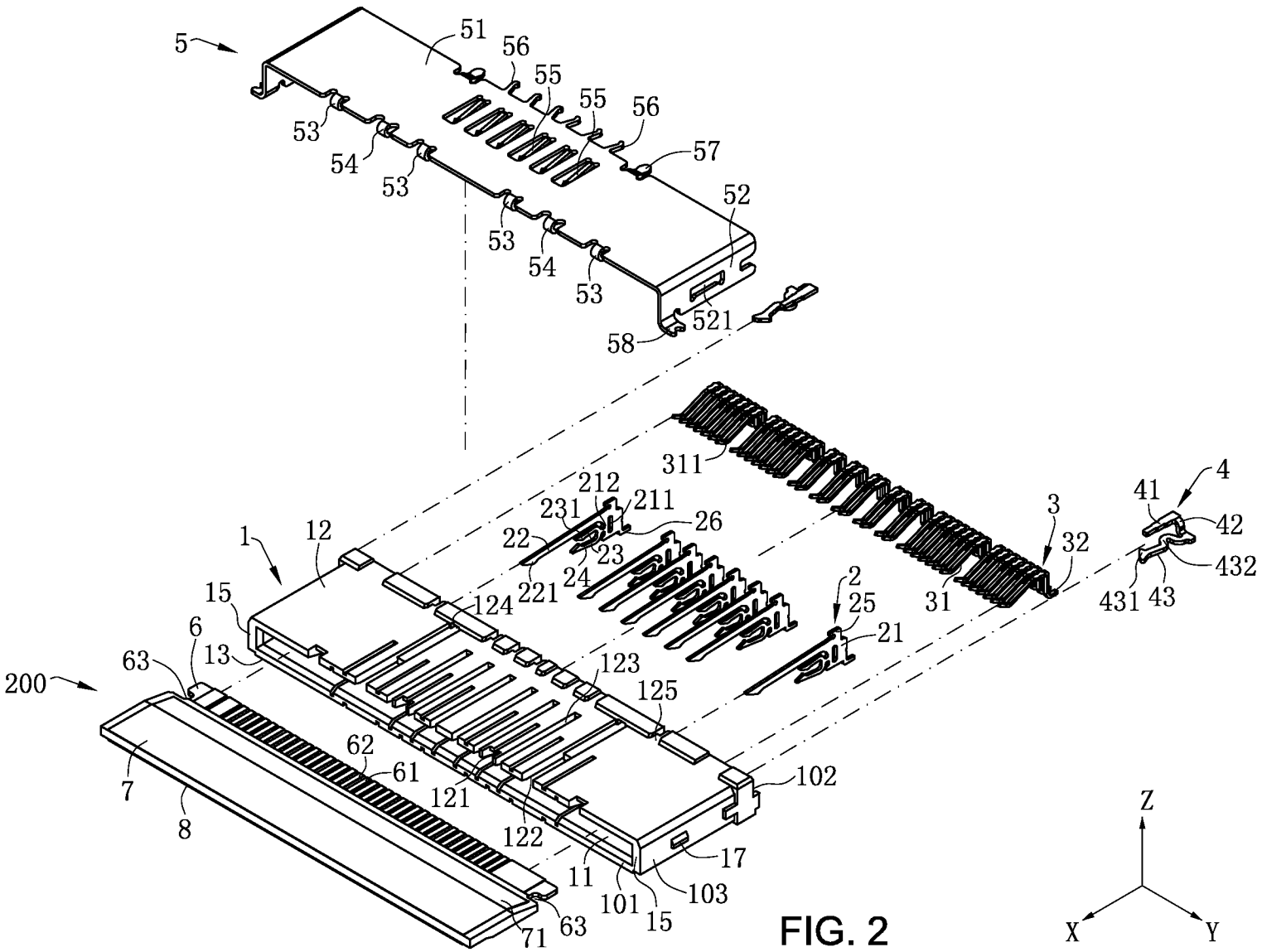
FIG. 2 is a perspective exploded view of the connector assembly in FIG. 1.
Figure 3:
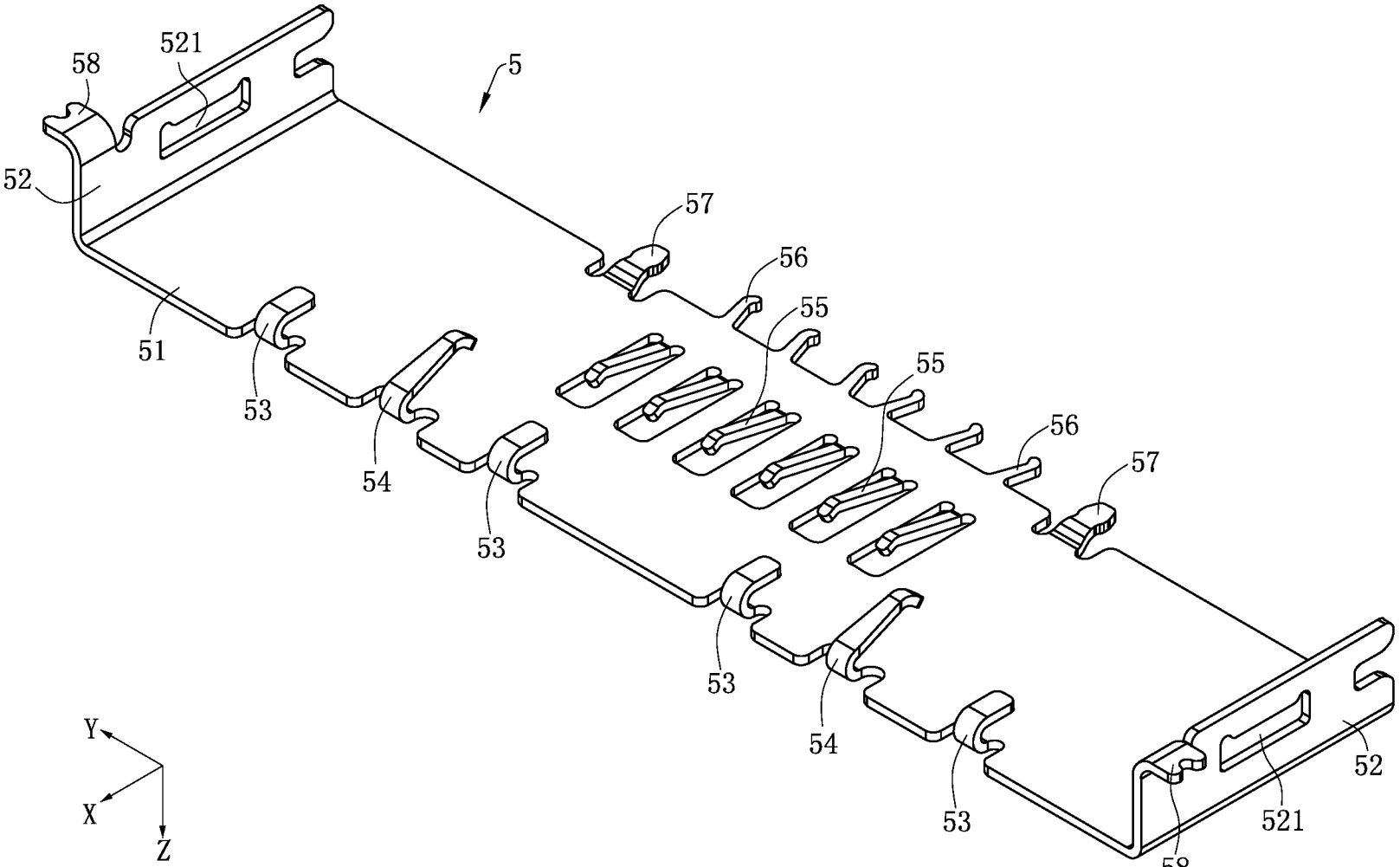
FIG. 3 is a perspective view of a metal shell of the electrical connector in FIG. 2 being 180° inversed.

Referring to FIG. 2 and FIG. 3, the electrical connector 100 has an insulating body 1, a plurality of ground terminals 2 and a plurality of signal terminals 3 provided on the insulating body 1, two fixing members 4 retained to a left side and a right side of the insulating body 1, and a metal shell 5 covering outside the insulating body 1.

Figure 4:
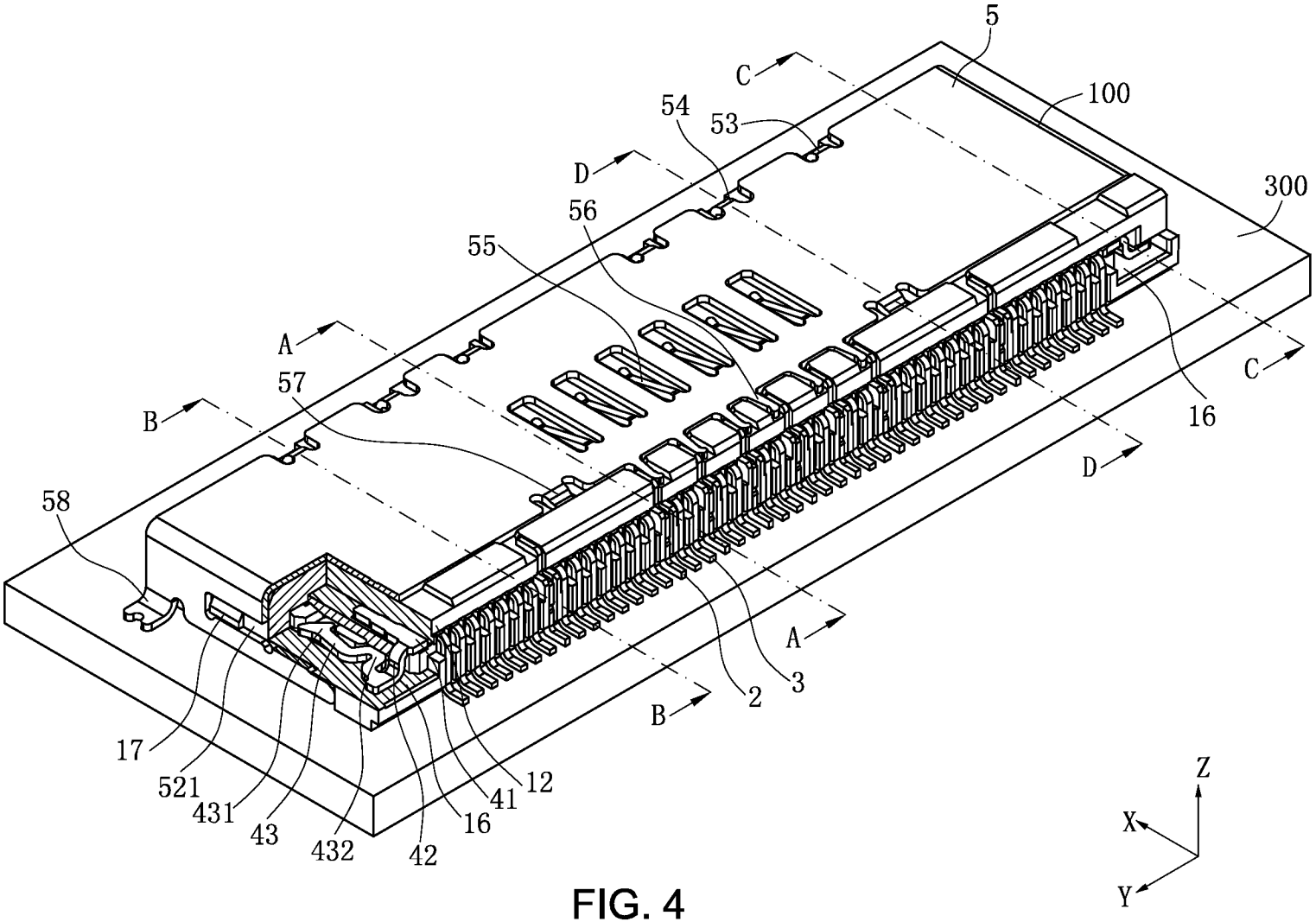
FIG. 4 is a partially sectional view of a mating member being inserted with the electrical connector in FIG. 1.

Referring to FIG. 2 and FIG. 4, the insulating body 1 is provided with a front end surface 101, a back end surface 102 and two side surfaces 103. The front end surface 101 and the back end surface 102 are provided opposite to each other in the front-rear direction. The two side surfaces 103 connect the front end surface 101 and the back end surface 102 respectively. The front end surface 101 is concavely formed with a mating slot 11 backward for insertion of the mating member 200 therein. The insulating body 1 has a top wall 12 located above the mating slot 11, a bottom wall 13 located below the mating slot 11, and a rear wall 14 connecting the top wall 12 and the bottom wall 13. The rear wall 14 is located behind the mating slot 11. The insulating body 1 is also provided with two side walls 15 located at a left side and a right side of the mating slot 11. The side walls 15 connect the top wall 12 and the bottom wall 13 respectively.

Referring to FIG. 2 and FIG. 4, the top wall 12 has a plurality of first grooves 121, a plurality of second grooves 122 and a plurality of third grooves 123 backward concavely provided on the front end surface 101. A front portion of each of the first grooves 121 close to the front end surface 101 runs vertically through the top wall 12, and are in downward communication with the mating slot 11. A rear portion of each of the first grooves 121 away from the front end surface 101 only runs downward through the top wall 12, and are in downward communication with the mating slot 11. The second grooves 122 and the third grooves 123 respectively run vertically through the top wall 12, and are in downward communication with the mating slot 11. A length of each third groove 123 in the front-rear direction is greater than a length of each second groove 122 in the front-rear direction. Each first groove 121 is located between two third grooves 123 in the left-right direction. The top wall 12 is further concavely provided with a plurality of fixing grooves 124 downward and backward at a portion thereof close to the back end surface 102. A rear end of each fixing groove 124 neither runs upward nor runs downward through the top wall 12. The fixing grooves 124 are located behind the second grooves 122, and the fixing grooves 124 and the second grooves 122 are located on a same straight line in the front-rear direction.

Referring to FIG. 2 and FIG. 4, the back end surface 102 is forward concavely provided with two accommodating grooves 16 and a plurality of mounting slots 125. The two accommodating grooves 16 are located on the left side and the right side of the mating slot 11 respectively. Each accommodating groove 16 accommodates one of the fixing members 4. A front portion of each accommodating groove 16 is in communication with the mating slot 11 in the left-right direction. The mounting slots 125 are located above the mating slot 11 and behind the mating slot 11. The mounting slots 125 run upward through the top wall 12. A protruding block 17 is formed by protruding out of each side surface 103.

Figure 5:
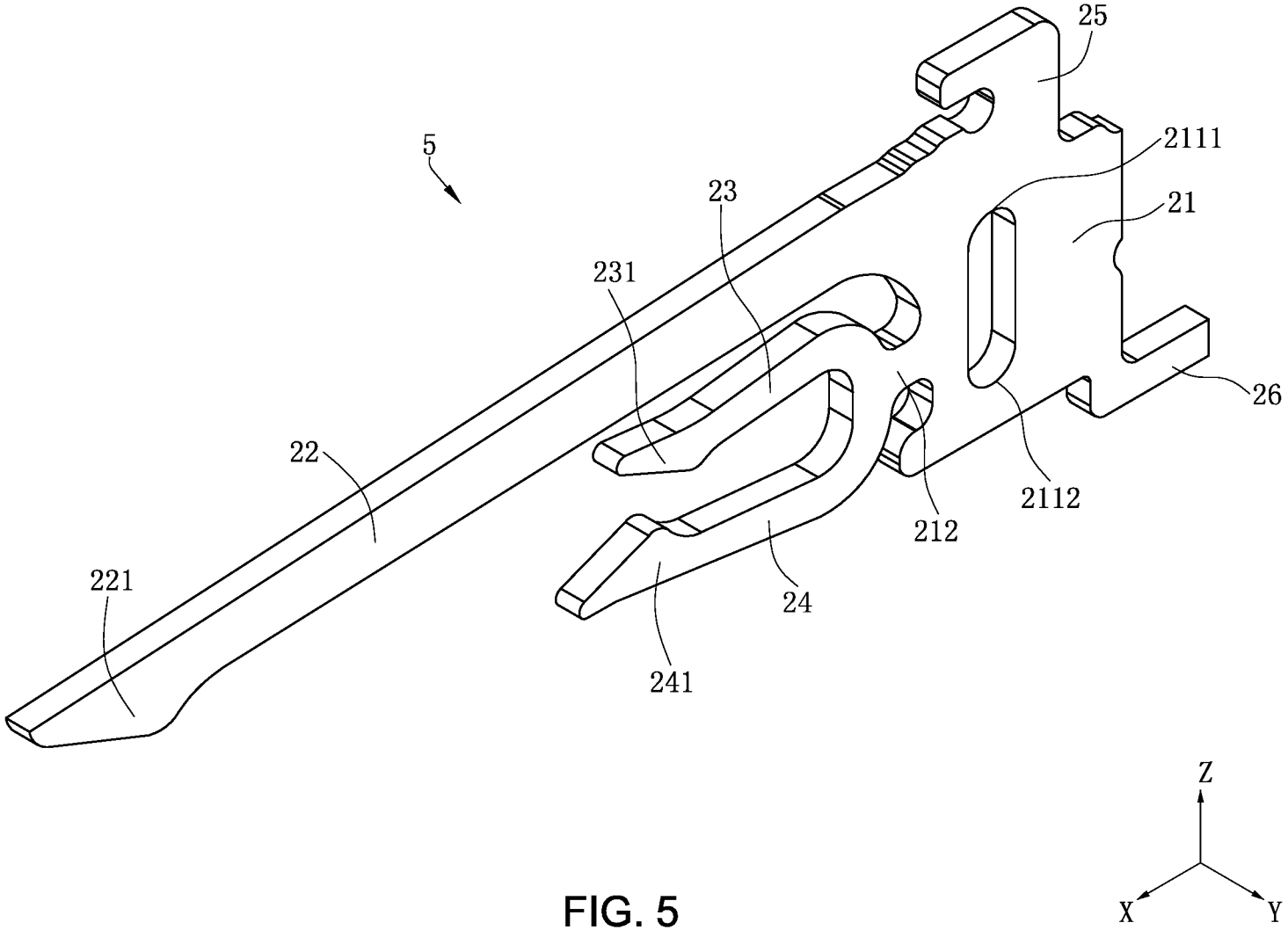
FIG. 5 is a perspective view of a ground terminal in FIG. 1.
Figure 6:
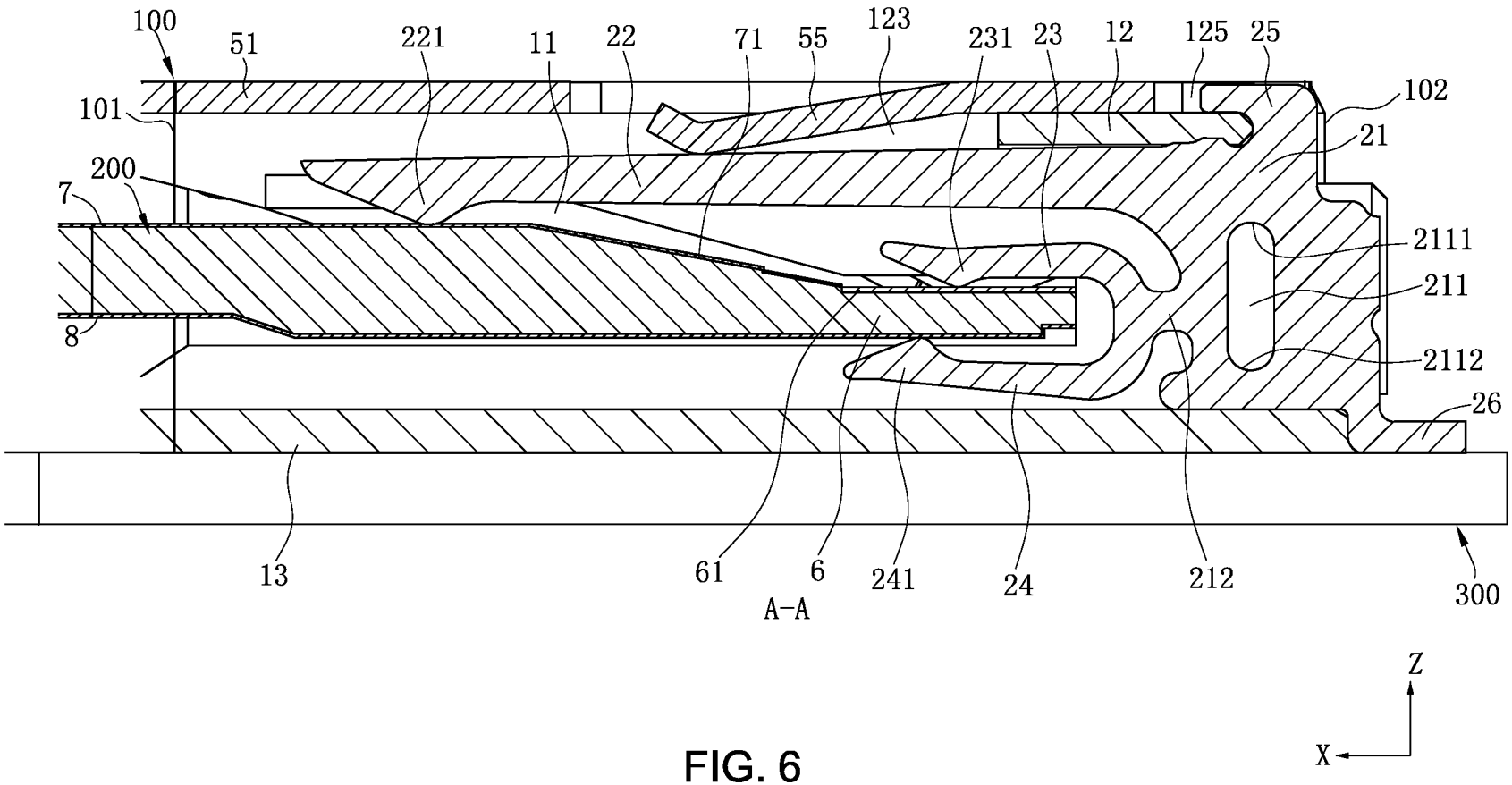
FIG. 6 is a sectional view of FIG. 3 along line A-A.

Referring to FIG. 2, FIG. 5 and FIG. 6, in the present embodiment, the ground terminals 2 are formed by directly blanking a metal plate. That is, the ground terminals 2 are blanking-type terminals, and are made of a copper material. The ground terminals 2 are inserted into the insulating body 1 forward from back thereof. Each ground terminal 2 has a main body 21 which is in a flat plate shape. The main body 21 is retained to the insulating body 1. The main body 21 is provided with a through hole 211, which runs through the main body 21 in the left-right direction, and has an upper edge 2111 and a lower edge 2112.

Referring to FIG. 2 and FIG. 6, a first elastic arm 22 extends from the main body 21 toward the mating slot 11. That is, the first elastic arm 22 is formed by extending forward from the main body 21. The first elastic arm 22 is provided with a first contact portion 221 protruding downward into the mating slot 11.

Referring to FIG. 5 and FIG. 6, the main body 21 is provided with a connecting portion 212 extending forward. The connecting portion 212 and the through hole 211 are aligned with each other in the front-rear direction. The connecting portion 212 is located below the first elastic arm 22, and is located between the upper edge 2111 and the lower end 2112 in the vertical direction. A front end of the connecting portion 212 is upward connected to a second elastic arm 23 and downward connected to a third elastic arm 24. The second elastic arm 23 and the third elastic arm 24 respectively extend forward. The second elastic arm 23 is provided with a second contact portion 231 protruding downward into the mating slot 11. The third elastic arm 24 is provided with a third contact portion 241 protruding upward into the mating slot 11. A distance between the second contact portion 231 and the third contact portion 241 in the vertical direction is greater than a width of the connecting portion 212 in the vertical direction. In the front-rear direction, the third contact portion 241 is located between the first contact portion 221 and the second contact portion 231.

Referring to FIG. 4 and FIG. 6, the main body 21 further extends upward to form an extending arm 25. The extending arm 25 protrudes into one mounting slot 125, and is exposed upward out of the top wall 12.

Referring to FIG. 5 and FIG. 6, a bottom end of the main body 21 extends backward to form a ground soldering leg 26. The ground soldering leg 26 is exposed backward from the insulating body 1 and soldered with the circuit board 300 to form electrical connection therebetween.

Figure 7:
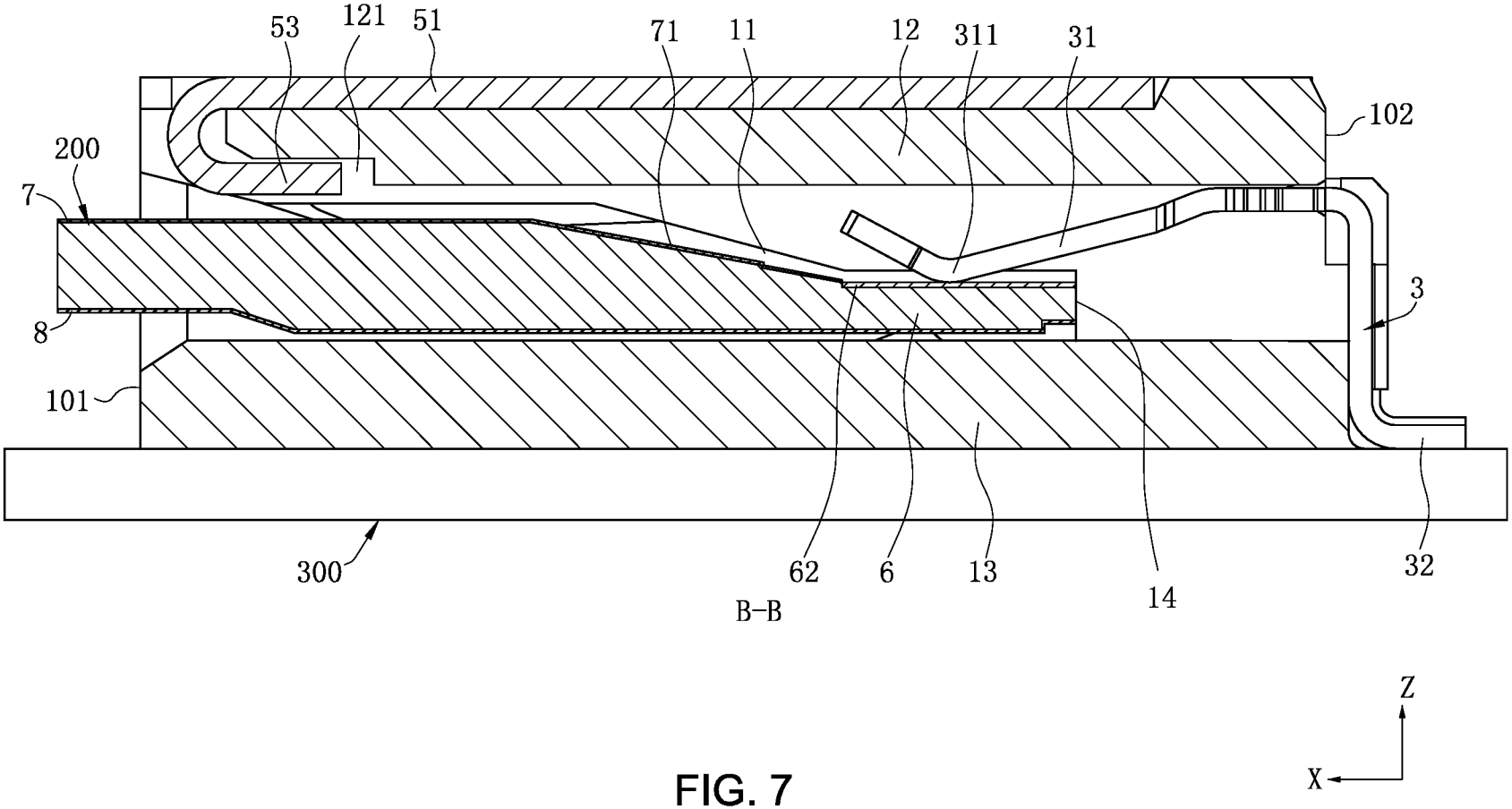
FIG. 7 is a sectional view of FIG. 3 along line B-B.
Figure 8:
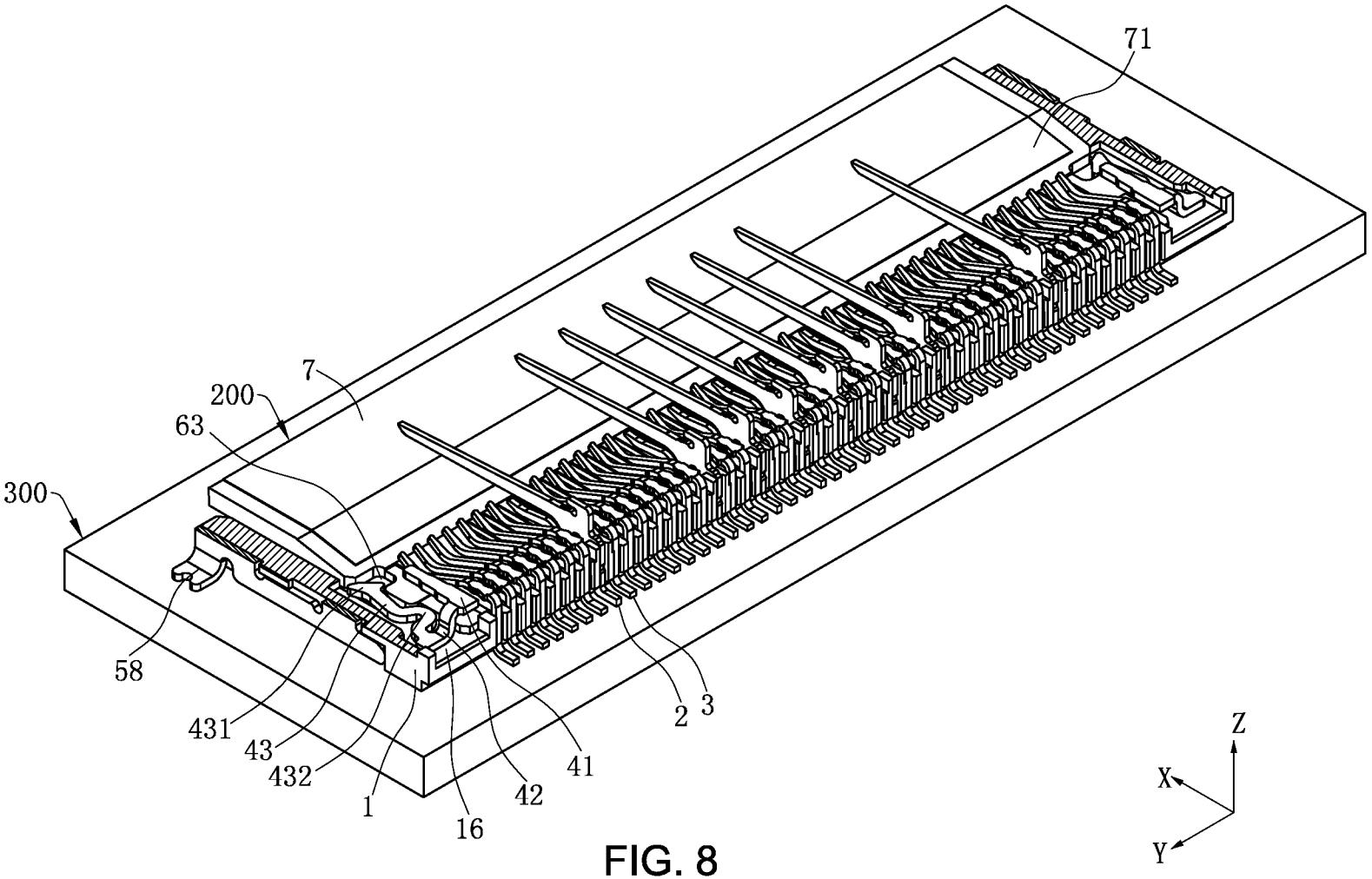
FIG. 8 is a schematic view of FIG. 4 being cut to expose the mating component.

Referring to FIG. 2 and FIG. 7, the signal terminals 3 are formed by continuously punching a metal plate. Each signal terminal 3 is provided with a resilient arm 31 formed by extending forward. The resilient arm 31 is provided with a conducting portion 311 protruding downward into the mating slot 11. The conducting portion 311 and the second contact portion 231 are located at a same height in the vertical direction, and the conducting portion 311 is aligned with the second contact portion 231 in the left-right direction. Each signal terminal 3 further has a signal soldering leg 32 exposed backward out of the insulating body 1 and soldered with the circuit board 300 to form electrical connection therebetween.

Referring to FIG. 2, FIG. 8, FIG. 9 and FIG. 10, the two fixing members 4 are located at the left side and the right side of the mating slot 11, and are mounted into the two accommodating grooves 16 forward from back thereof. Each fixing member 4 is provided with a retaining portion 41 fixed to the insulating body 1, and an outer edge of the retaining portion 41 is step-shaped forward from back thereof. The retaining portion 41 is retained to the top wall 12 and extends forward out of the rear wall 14. An extending portion 42 bends and extends downward from one side of a rear end of the retaining portion 41, and a buckling arm 43 extends forward from the extending portion 42. The buckling arm 43 is located below the retaining portion 41. Since the buckling arm 43 and the retaining portion 41 are located on different planes in the vertical direction, which reasonably utilize the space of the insulating body 1 in the vertical direction, the retaining portion 41 meets a length required by design, thus stably fixing each fixing member 4 in the corresponding accommodating groove 16. The buckling arm 43 has a buckling portion 431, and the buckling portion 431 protrudes into the mating slot 11 in the left-right direction. The buckling arm 43 is provided with a bending section 432. The bending section 432 protrudes toward the mating slot 11 in the left-right direction, and is located between the buckling portion 431 and the extending portion 42 in the front-rear direction. The bending section 432 increases the elasticity of the buckling arm 43.

Referring to FIG. 2 and FIG. 4, the metal shell 5 is formed by punching a metal plate. The metal shell 5 is mounted to the outer side of the insulating body 1 backward from front thereof. The metal shell 5 has a top plate 51 located above the insulating body 1, and each of two sides of the top plate 51 extends downward to form a side plate 52. The two side plates 52 correspondingly cover outside the two side walls 15.

Referring to FIG. 2 and FIG. 3, a front end of the top plate 51 bends and extends downward and backward to form a plurality of bending portions 53. The bending portions 53 extend into the first grooves 121 and are in fastening fit with the insulating body 1, so as to prevent the metal shell 5 from falling off. The bending portions 53 are located behind the front end surface 101.

Figure 11:
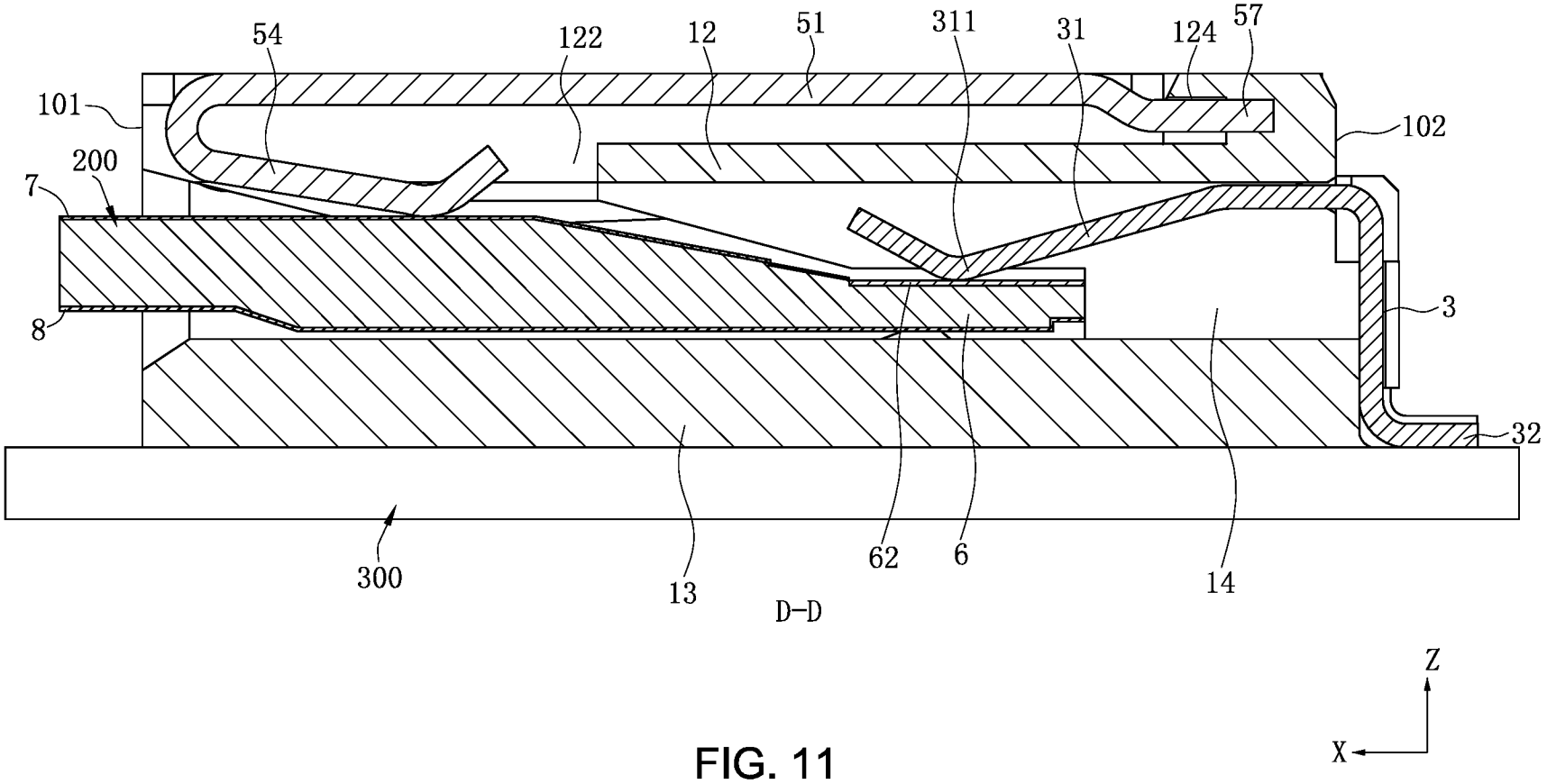
FIG. 11 is a sectional view of FIG. 3 along line D-D.

Referring to FIG. 2, FIG. 3 and FIG. 11, the metal shell 5 has a plurality of abutting arms 54 connected to the top plate 51. Each abutting arm 54 is formed by bending and extending downward from the front end of the top plate 51, and is located between two bending portions 53 in the left-right direction. The abutting arms 54 protrude into the corresponding second grooves 122.

Referring to FIG. 2, FIG. 3 and FIG. 6, a middle position of the top plate 51 is punched downward to form a plurality of abutting elastic sheets 55. The abutting elastic sheets 55 are cantilevers extending forward from back thereof. The abutting elastic sheets extend into the corresponding third grooves 123 and are in downward contact with the first elastic arms 22, so as to enhance the shielding function of the metal shell 5.

Figure 12:
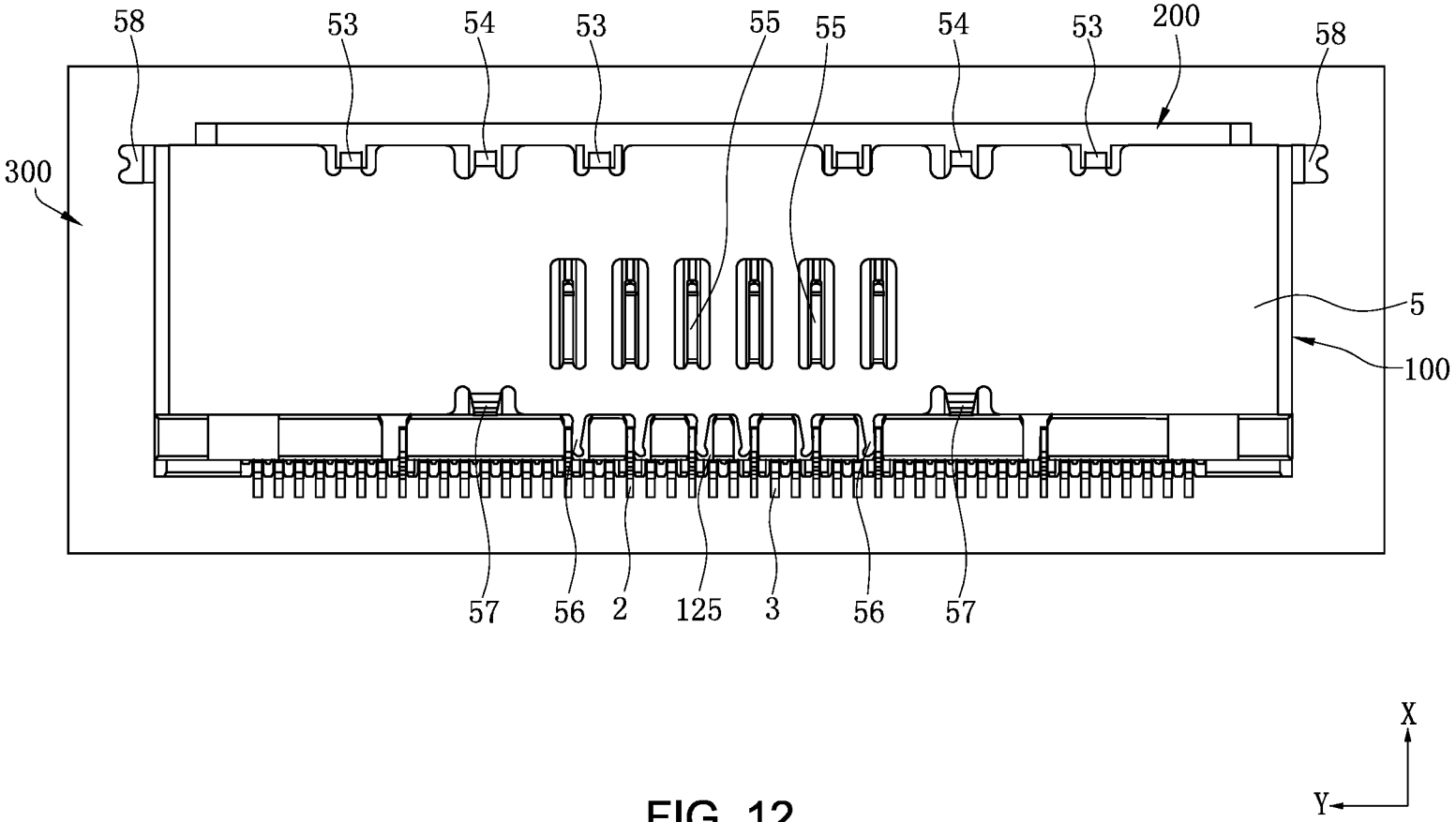
FIG. 12 is a top view of the mating member being inserted with the electrical connector in FIG. 1.

Referring to FIG. 2, FIG. 3 and FIG. 12, the top plate 51 extends backward to form a plurality of contact elastic arms 56 and a plurality of fixing arms 57. The contact elastic arms 56 correspondingly extend backward into the mounting slots 125. Each contact elastic arm 56 is in lateral contact with the corresponding extending arm 25 in the left-right direction, thus further enhancing the shielding function of the metal shell 5 and improving the high frequency performance of the electrical connector 100. The fixing arms 57 are correspondingly inserted backward into the fixing grooves 124, such that the metal shell 5 and the insulating body 1 are fixed with each other.

Referring to FIG. 2, FIG. 3 and FIG. 4, each side plate 52 is provided with a fastening hole 521 running through the side plate 52 in the left-right direction. When the metal shell 5 is mounted to the insulating body 1 backward from front thereof, the protruding blocks 17 are fastened into the corresponding fastening holes 521. A ground portion 58 horizontally extends outward from the lower edge 2112 of each side plate 52. The ground portion 58 is soldered to the circuit board 300, such that the metal shell 5 and the circuit board 300 form a grounding connection.

Referring to FIG. 1 and FIG. 2, the mating member 200 has a mating portion 6. An upper surface of the mating portion 6 is provided with a plurality of ground conductive sheets 61 and a plurality of signal conductive sheets 62 arranged side by side in the left-right direction. The ground conductive sheets 61 and the signal conductive sheets 62 are respectively exposed upward outside the mating portion 6. Each of a left side and a right side of the mating portion 6 is concavely provided with a concave portion 63. The mating member 200 is provided with an upper shielding member 7 covering an upper side of the mating member 200, and a rear portion of the upper shielding member 7 is provided with an inclined surface 71 inclining backward and downward. The inclined surface 71 is located in front of the mating portion 6. The inclined surface 71 is used as a guide to reduce an insertion force for inserting the mating member 200 into the electrical connector 100, thus avoiding the electrical connector 100 from being damaged. The mating member 200 has a lower shielding member 8 covering a lower side of the mating member 200, and a rear end of the lower shielding member 8 covers a lower surface of the mating portion 6.

Figure 9:
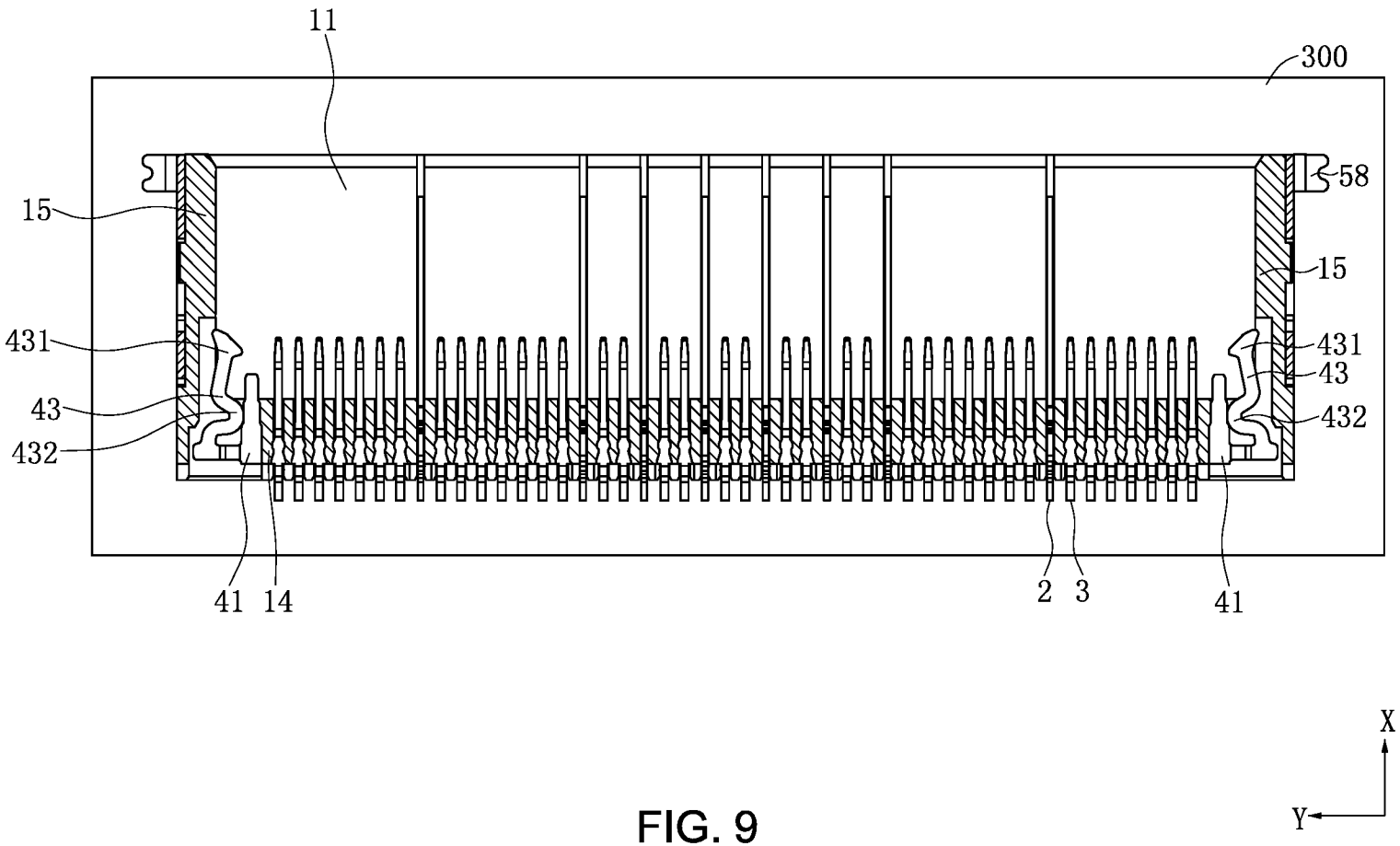
FIG. 9 is a top view of the electrical connector not being inserted with the mating member in FIG. 7.
Figure 10:
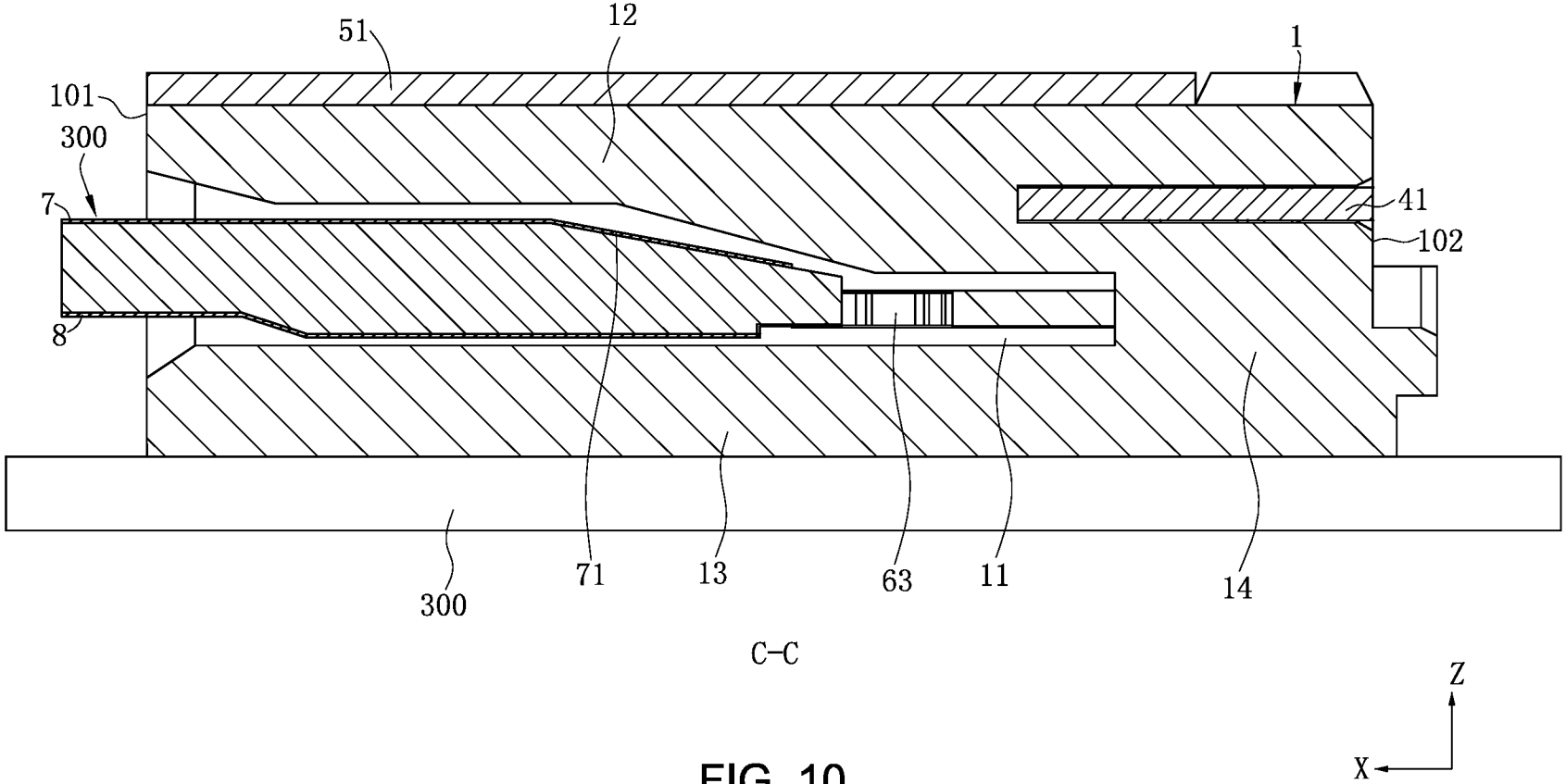
FIG. 10 is a sectional view of FIG. 3 along line C-C.

Referring to FIG. 6 and FIG. 9, in a process of the mating member 200 being inserted backward into the mating slot 11, the first contact portion 221 is in downward contact with the upper shielding member 7 to form grounding, and slides on the upper shielding member 7 forward from back thereof. The first contact portion 221 facilitates the insertion of the mating member 200 through the guidance of the inclined surface 71, and reduces the insertion force thereof. After the mating member 200 is completely inserted into the mating slot 11, the first contact portion 221 is in downward contact with the upper shielding member 7, and a contact position between the two components is located in front of the inclined surface 71. The second contact portion 231 is in downward contact with the corresponding ground conductive sheet 61. The conducting portion 311 is in upward contact with the corresponding signal conductive sheet 62. The third contact portion 241 is in upward contact with the lower shielding member 8. When the second contact portion 231 and the third contact portion 241 clamp the mating portion 6, the second elastic arm 23 and the third elastic arm 24 may deform. Due to the presence of the connecting portion 212, the elasticity of the ground terminal 2 is increased, and a buffer effect is achieved, thereby preventing the second elastic arm 23 and the third elastic arm 24 from being broken. On the other hand, the through hole 211 is provided behind the connecting portion 212, and the connecting portion 212 is located between the upper edge 2111 and the lower edge 2112 in the vertical direction to provide a reserved space for the connecting portion 212, which further increases the elasticity of the connecting portion 212. The buckling portion 431 extends into the corresponding concave portion 63 to perform fastening, so as to prevent the mating member 200 from falling off from the electrical connector 100.

Referring to FIG. 6, the first contact portion 221 is in downward contact with the upper shielding member 7, such that the first elastic arm 22 applies a downward acting force to the mating member 200, which is transmitted through the mating member 200 to act on the insulating body 1. Since the insulating body 1 is mounted downward on the circuit board 300, the circuit board 300 located below the insulating body 1 provides an upward supporting force to the insulating body 1, which counteracts the acting force applied by the first elastic arm 22, preventing the insulating body 1 from deformation, and prolonging the service life of the electrical connector 100.

Figure 13:
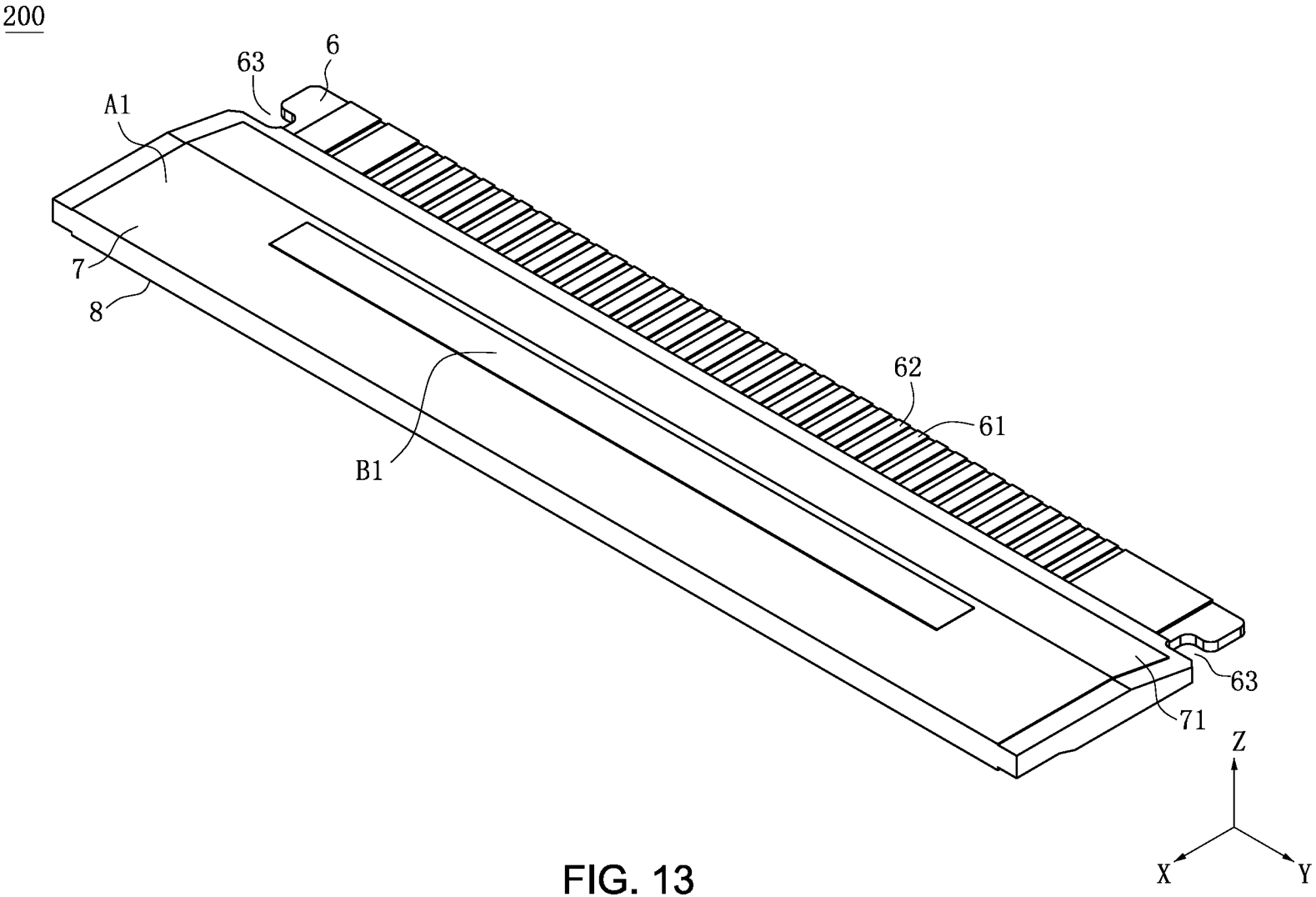
FIG. 13 is a schematic view of another structure of the mating member in FIG. 1.

Referring to FIG. 6 and FIG. 13, in certain embodiments, each of the upper shielding member 7 and the lower shielding member 8 has a copper foil A1 and a gold layer B1 plated on the upper surface of the copper foil A1. Since the ground conductive sheet 61 is generally formed by a copper foil, and the ground terminal 2 is made of a copper material, when the first contact portion 221 of the ground terminal 2 is in contact with the gold layer B1 on the upper shielding member 7, the second contact portion 231 is in contact with the ground conductive sheet 61. When the third contact portion 241 is in contact with the gold layer B1 of the lower shielding member 8, the materials of the ground terminal 2, the upper shielding member 7 and the lower shielding member 8 are substantially made of copper, a potential difference between a contact point of the ground terminal 2 and the ground conductive sheet 61 and contact points of the ground terminal 2 and the upper shielding member 7 as well as the lower shielding member 8 may be reduced, thus reducing the influence of an extremely large potential difference on the high frequency performance of the electrical connector 100 during signal transmission. In addition, the portions of the upper shielding member 7 and the lower shielding member 8 respectively in contact with the ground terminal 2 are the gold layers B1, such that the arrangement of the gold layers B1 may enhance the electrical connection therebetween.

Figure 14:
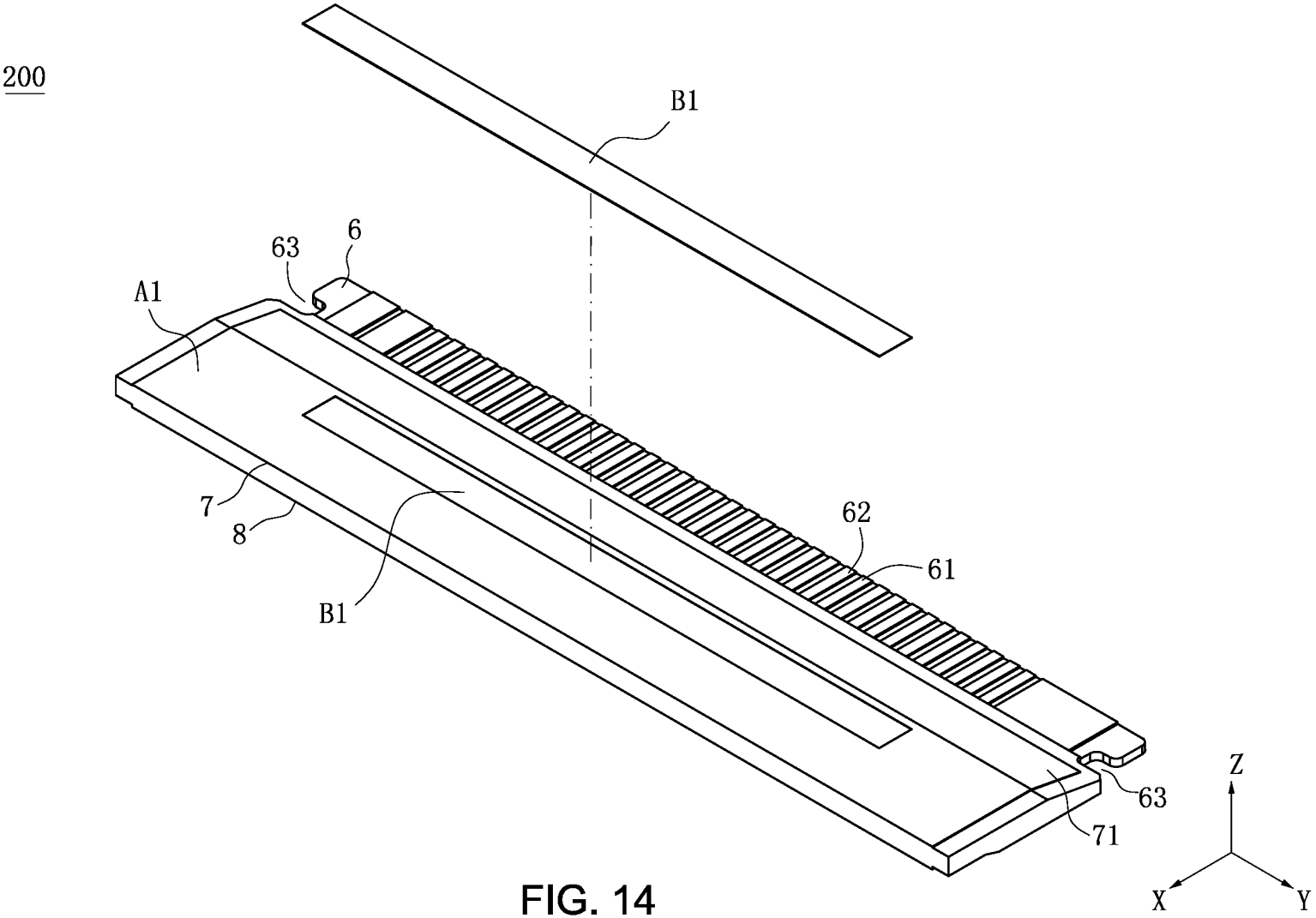
FIG. 14 is a schematic view of a further structure of the mating member in FIG. 1.

Referring to FIG. 14, in some other embodiments, the copper foil A1 is provided with an opening C1, and the gold layer B1 is embedded in the opening C1, which may achieve the above objective as well.

To sum up, the electrical connector and the connector assembly according to certain embodiments of the present invention have the following beneficial effects:

1. The ground terminal 2 is provided with the first elastic arm 22 and the second elastic arm 23, which are located at a same side of the mating member 200. The first contact portion 221 downward abuts the upper shielding member 7, and the second contact portion 231 is in downward contact with the ground conductive sheet 61. The first contact portion 221 is located in front of the second contact portion 231. The first elastic arm 22 applies a downward acting force to the mating member 200, which is transmitted through the mating member 200 to act on the insulating body 1. Since the insulating body 1 is mounted downward on the circuit board 300, the circuit board 300 located below the insulating body 1 provides an upward supporting force to the insulating body 1, which counteracts the acting force applied by the first elastic arm 22, preventing the insulating body 1 from deformation, and prolonging the service life of the electrical connector 100.

2. The metal shell 5 is provided with the abutting arms 54, the abutting elastic sheets 55 and the contact elastic arms 56. The abutting arms 54 are in contact with the upper shielding member 7, and the abutting elastic sheets 55 and the contact elastic arms 56 are all in contact with the ground terminals 2. The shielding function of the metal shell 5 is enhanced through the multiple contacts between the metal shell 5 and the upper shielding member 7 as well as between the metal shell 5 and the ground terminals 2, such that the high frequency performance of the electrical connector 100 is significantly improved.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, mounted downward on a circuit board, and configured to mate with a mating member having an upper shielding member located at an upper side thereof and at least one ground conductive sheet, the electrical connector comprising:

an insulating body, provided with a front end surface, wherein the front end surface is backward concavely provided with a mating slot for the mating member to be inserted therein; and at least one ground terminal, wherein each of the at least one ground terminal has a main body provided on the insulating body, a first elastic arm and a second elastic arm extend forward from the main body, the first elastic arm has a first contact portion exposed downward from the mating slot to be in downward contact with the upper shielding member, the second elastic arm has a second contact portion exposed downward from the mating slot to be in downward contact with the ground conductive sheet, and the first contact portion is located in front of the second contact portion;

wherein the mating member has a lower shielding member located at a lower side thereof, a third elastic arm extends forward from the main body; the third elastic arm has a third contact portion exposed upward from the mating slot to be in upward contact with the lower shielding member, and the third contact portion is located between the first contact portion and the second contact portion;

wherein the main body has a connecting portion connecting the second elastic arm and the third elastic arm, and a distance between the second contact portion and the third contact portion in a vertical direction is greater than a width of the connecting portion in the vertical direction.

2. The electrical connector according to claim 1 wherein the main body is provided with a through hole running therethrough in a left-right direction, the through hole is located behind the connecting portion, and the through hole and the connecting portion are aligned with each other in a front-rear direction.

3. The electrical connector according to claim 1, further comprising two fixing members located at a left side and a right side of the mating slot, wherein each of the fixing members is provided with a retaining portion fixed to the insulating body, an extending portion bending and extending from the retaining portion, and a buckling arm extending forward from the extending portion, and the buckling arm has a buckling portion protruding into the mating slot to buckle with the mating member.

4. The electrical connector according to claim 3, wherein the insulating body has a top wall located above the mating slot, a bottom wall located below the mating slot, and a rear wall connecting the top wall and the bottom wall, and the retaining portion of each of the fixing members is retained to the top wall and extend forward out of the rear wall.

5. The electrical connector according to claim 3, wherein the buckling arm has a bending section, and the bending section is formed by protruding toward the mating slot in a left-right direction.

6. The electrical connector according to claim 3, wherein the retaining portion and the buckling arm are located at different heights in a vertical direction.

7. The electrical connector according to claim 1, further comprising a metal shell covering outside the insulating body, wherein the metal shell comprises a top plate located above the insulating body, each of two sides of the top plate downwards extends to form a side plate, the metal shell has at least one abutting arm connected to the top plate, and the abutting arm is exposed from the mating slot to be in contact with the upper shielding member.

8. The electrical connector according to claim 7, wherein each of the at least one abutting arm is formed by bending and extending downward from a front end of the top plate, at least one bending portion is formed by bending and extending downward and backward from the front end of the top plate; and the bending portion and the insulating body are in fastening fit.

9. The electrical connector according to claim 7, wherein at least one abutting elastic sheet is formed by protruding downward from a plate surface of the top plate, and the abutting elastic sheet downward abuts the first elastic arm.

10. The electrical connector according to claim 7, wherein at least one contact elastic arm extends backward from the top plate to be in contact with the ground terminal.

11. The electrical connector according to claim 10, wherein the insulating body has a back end surface, the back end surface is concavely provided with a mounting slot forward from back thereof, the mounting slot runs upward through the insulating body, an extending arm extends upward from the main body and protrudes into the mounting slot, and the contact elastic arm laterally abuts the extending arm in a left-right direction.

12. An electrical connector, mounted downward on a circuit board, and configured to mate with a mating member having an upper shielding member located at an upper side thereof, at least one signal conductive sheet, at least one ground conductive sheet and a lower shielding member located at a lower side thereof, the electrical connector comprising:

an insulating body, provided with a front end surface, wherein the front end surface is backward concavely provided with a mating slot for the mating member to be inserted therein;

at least one ground terminal, wherein each of the at least one ground terminal has a main body provided on the insulating body, a first elastic arm, a second elastic arm and a third elastic arm extend forward from the main body, the first elastic arm has a first contact portion exposed downward from the mating slot to be in downward contact with the upper shielding member, the second elastic arm has a second contact portion exposed downward from the mating slot to be in downward contact with the ground conductive sheet, the third elastic arm has a third contact portion exposed upward from the mating slot to be in upward contact with the lower shielding member, and the first contact portion is located in front of the second contact portion and the third contact portion; and at least one signal terminal, provided on the insulating body, wherein each of the at least one signal terminal has a fourth contact portion exposed downward from the mating slot to be in downward contact with the signal conductive sheet.

13. The electrical connector according to claim 12, wherein the main body has a connecting portion connecting the second elastic arm and the third elastic arm, the second contact portion is located above the connecting portion, and the third contact portion is located below the connecting portion.

14. The electrical connector according to claim 13, wherein the main body is provided with a through hole running through the main body in a left-right direction, the through hole is located behind the connecting portion, the through hole has an upper edge and a lower edge, and the connecting portion is located between the upper edge and the lower edge.

15. The electrical connector according to claim 12, further comprising a metal shell covering outside the insulating body, wherein the metal shell comprises a top plate located above the insulating body, each of two sides of the top plate downwards extends to form a side plate, the metal shell has at least one abutting arm connected to the top plate and at least one contact elastic arm extending backward from the top plate, the abutting arm is exposed from the mating slot to be in contact with the upper shielding member, and the contact elastic arm is in contact with the ground terminal.

16. The electrical connector according to claim 15, wherein the metal shell has at least one abutting elastic sheet formed by punching from the plate surface of the top plate, and the abutting elastic sheet is a cantilever extending upward in a front-rear direction and downward abutting the first elastic arm.

17. The electrical connector according to claim 15, wherein the insulating body has a back end surface, the back end surface is concavely provided with at least one mounting slot forward from back thereof, the mounting slot is located above the mating slot and runs upward through the insulating body, an abutting arm extends upward from the main body and protrudes into the mounting slot, and the abutting arm and the contact elastic arm are in lateral contact in the left-right direction.

18. A connector assembly, comprising:

an electrical connector, configured to be mounted downward on a circuit board, wherein the electrical connector has an insulating body and at least one ground terminal provided on the insulating body, the insulating body is provided with a front end surface, the front end surface is backward concavely provided with a mating slot, each of the at least one ground terminal has a main body provided on the insulating body, a first elastic arm and a second elastic arm extend forward from the main body, the first elastic arm has a first contact portion exposed downward from the mating slot, the second elastic arm has a second contact portion exposed downward from the mating slot, and the first contact portion is located in front of the second contact portion; and a mating member, inserted into the mating slot, wherein the mating member has an upper shielding member located at an upper side thereof and at least one ground conductive sheet, an upper surface of the upper shielding member is provided with an inclined surface inclining downward, the inclined plane is located between the first contact portion and the second contact portion to guide the first contact portion, the first contact portion is in downward electrical contact with the upper shielding member, and the second contact portion is in downward electrical contact with the ground conductive sheet;

wherein the mating member has a lower shielding member located at a lower side thereof, a third elastic arm extends forward from the main body; the third elastic arm has a third contact portion exposed upward from the mating slot to be in upward contact with the lower shielding member, and the third contact portion is located between the first contact portion and the second contact portion;

wherein the main body has a connecting portion connecting the second elastic arm and the third elastic arm, and a distance between the second contact portion and the third contact portion in a vertical direction is greater than a width of the connecting portion in the vertical direction.

19. The connector assembly according to claim 18, wherein the upper shielding member is provided with a copper foil and a gold layer plated on an upper surface of the copper foil, and the first contact portion abuts the gold layer.

20. The connector assembly according to claim 18, wherein the upper shielding member comprises a copper foil provided with an opening and a gold layer embedded in the opening, and the first contact portion abuts the gold layer.

* * * * *